US005280279A

United States Patent [19]

Nakazawa et al.

[11] Patent Number: 5,280,279

[45] Date of Patent: Jan. 18, 1994

[54] DRIVING CIRCUIT FOR PRODUCING VARYING SIGNALS FOR A LIQUID CRYSTAL DISPLAY APPARATUS

[75] Inventors: Kiyoshi Nakazawa, Fujiidera; Naofumi Kondo, Nara; Mikio Katayama, Ikoma; Tsuneo Nakamura, Nara, all of Japan

[73] Assignee: Sharp Kabushiki Kaisha, Osaka, Japan

[21] Appl. No.: 631,699

[22] Filed: Dec. 19, 1990

[30] Foreign Application Priority Data

Dec. 21, 1989 [JP] Japan ..... 1-333092

[51] Int. Cl.[5] ..... G09G 3/36

[52] U.S. Cl. ..... 345/38; 345/84; 345/50; 345/208; 345/96

[58] Field of Search ..... 340/784, 811, 805; 330/110; 359/85; 358/236; 307/263, 262, 268, 490; 364/852

[56] References Cited

U.S. PATENT DOCUMENTS 4,259,686 3/1981 Suzuki et al. ..... 307/262
4,670,714 6/1987 Sievers et al. ..... 307/262
4,710,727 12/1987 Rutt ..... 330/110
4,859,872 8/1989 Hyakutake ..... 307/262
4,899,141 2/1990 Morozumi et al. ..... 340/811

FOREIGN PATENT DOCUMENTS 0196889 10/1986 European Pat. Off. .
0323260 7/1989 European Pat. Off. .

OTHER PUBLICATIONS

Proceedings of the SID, vol. 29, No. 1, 1988, New York US, pp. 99-103, "Compensation of the Display Electrode Voltage Distortion", Yanagisawa et al.

*Primary Examiner*—Howard W. Britton
*Assistant Examiner*—A. Au
*Attorney, Agent, or Firm*—Nixon & Vanderhye

[57] ABSTRACT

A driving circuit which can drive an LCD apparatus without causing the residual image phenomenon is disclosed. The driving circuit has a polarity-inverting circuit for converting input video signals into polarity-alternating signals. The polarity-inverting circuit has input-output characteristics which are at least partially non-linear. The input-output characteristics are linear in the positive region, and non-linear in the negative region, or non-linear in the positive region, and linear in the negative region.

7 Claims, 6 Drawing Sheets

DRIVING CIRCUIT FOR PRODUCING VARYING SIGNALS FOR A LIQUID CRYSTAL DISPLAY APPARATUS

BACKGROUND OF THE INVENTION

1. Field of the invention

This invention relates to a driving circuit for a liquid crystal display apparatus, and more particularly to a driving circuit for a liquid crystal display apparatus in which thin film transistors are used as switching elements.

2. Description of the prior art

FIG. 6 shows a driving circuit for driving an active matrix type LCD apparatus 1 in which thin film transistors (TFTS) are arranged as switching elements in a matrix form. The driving circuit shown in FIG. 6 comprises a source driver 2, a data driver 3, a controller 4, and a polarity-inverting circuit 5. When a DC voltage is applied to the liquid crystal in the LCD apparatus 1, electrochemical reaction occurs in the liquid crystal, thereby deteriorating the liquid crystal. In order to prevent such deterioration from occurring, the driving circuit is provided with the polarity-inverting circuit 5 so that the LCD apparatus 1 is AC-driven.

The polarity-inverting circuit 5 generally comprises an amplifier, an inverter which inverts the polarity of the output of the amplifier, and a switching circuit which alternatingly selects either of the outputs of the amplifier and inverter to output the selected output. The polarity-inverting circuit 5 converts input video signals into polarity-inverted signals (AC signals). FIG. 7 shows gray scale video signals. For example, the polarity-inverting circuit 5 converts the video signals of FIG. 7 into polarity-inverted signals shown in FIG. 8.

When the LCD apparatus I displays the same time for a long period of time, the pattern is "memorized" in the liquid crystal, with the result in that some extent of time is required to completely distinguish this memorized pattern. Even when another pattern is to be displayed, therefore, this memorized pattern also appears as a residual image on the apparatus 1 (i.e., the residual image phenomenon occurs). This residual image phenomenon greatly impairs the image quality.

SUMMARY OF THE INVENTION

The driving circuit of this invention, which overcomes the above-discussed and numerous other disadvantages and deficiencies of the prior art, comprises a polarity-inverting circuit for converting input video signals into polarity-alternating signals, and said polarity-inverting circuit has input-output voltage characteristics which are at least partially non-linaer.

In preferred embodiments, the polarity-inverting circuit has input-output characteristics which are linear in a positive region, and non-linear in a negative region.

Alternatively, the polarity-inverting circuit may have input-output characteristics which are non-linear in a positive region, and linear in a negative region.

Thus, the invention described herein makes possible the objectives of:

(1) providing a driving circuit which can drive an LCD apparatus with an improved image quality; and (2) providing a driving circuit which can drive an LCD apparatus without causing the residual image phenomenon.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 6:
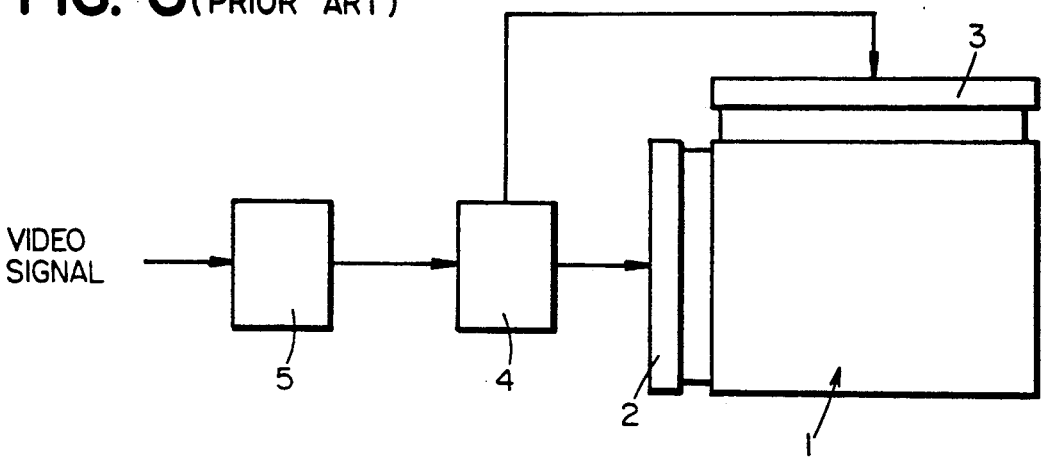
FIG. 6 (PRIOR ART)
FIG. 6 is a block diagram showing an LCD apparatus and a driving circuit.
Figure 7:
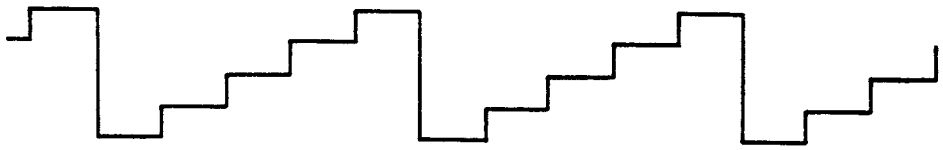
FIG. 7 (PRIOR ART)
FIG. 7 shows a waveform of video signals input to a polarity-inverting circuit.
Figure 8:
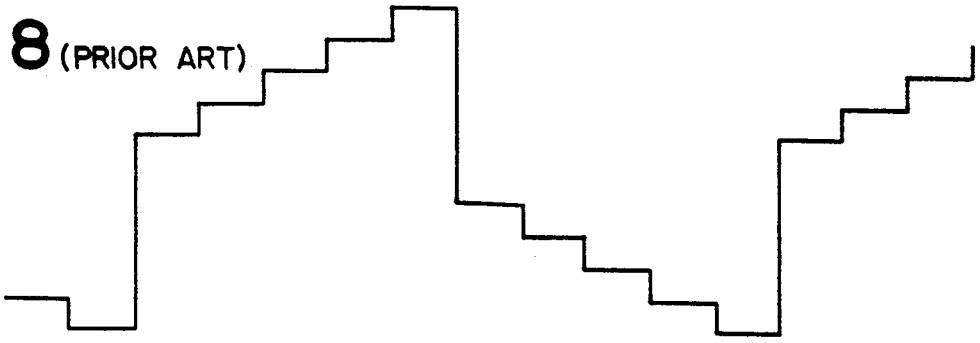
FIG. 8 (PRIOR ART)
FIG. 8 shows a waveform of signals output from a conventional polarity-inverting circuit.
Figure 9:
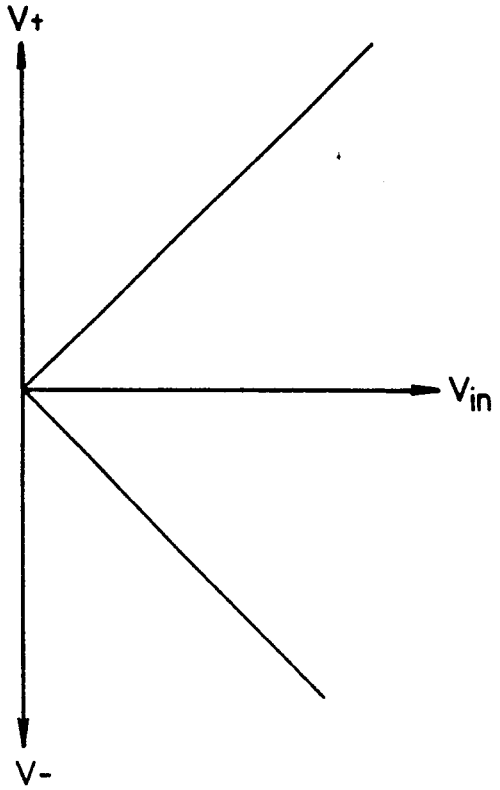
FIG. 9 (PRIOR ART)
FIG. 9 illustrates the first and fourth quadrants of a voltage plot representing positive and negative regions, respectively showing the input-output characteristic of polarity-inverting circuit used in a conventional driving circuit.
Figure 10:
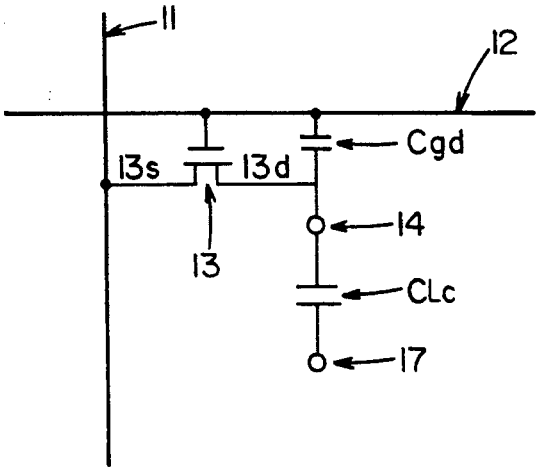
FIG. 10 is an equivalent circuit diagram of a pixel portion of an LCD apparatus.
Figure 11:
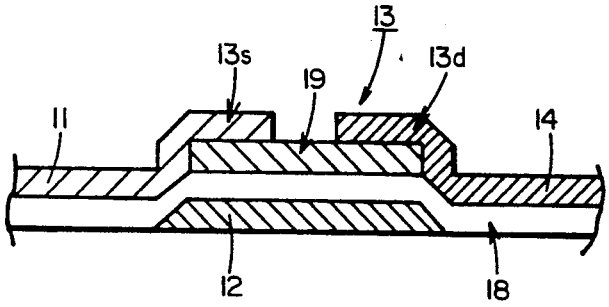
FIG. 11 is a cross section of a TFT.

Before describing embodiments of the invention, the generation mechanism of the residual image phenomenon will be described. FIG. 10 shows an equivalent circuit of a picture element (pixel) of the LCD apparatus 1 (FIG. 6). Each pixel is provided with a TFT 13. FIG. 11 shows the sectional structure of the TFT 13. The source electrode 13*s* and drain electrode 13*d* of the TFT 13 are connected to a source line 11 and a pixel electrode 14, respectively. A gate line 12 which perpendicularly intersects the source line 11 functions also as the gate electrode of the TFT 13. The numerals 18 and 19 in FIG. 11 indicate a gate insulating film, and a semiconductor film, respectively. In the pixel having the above-mentioned structure, a parasitic capacitance $C_{gd}$ is formed between the gate line 12 and the drain electrode 13*d*, and a pixel capacitance $C_{LC}$ is formed between the pixel electrode 14 and a counter electrode 17 which is opposite to the pixel electrode 14.

Figure 12:
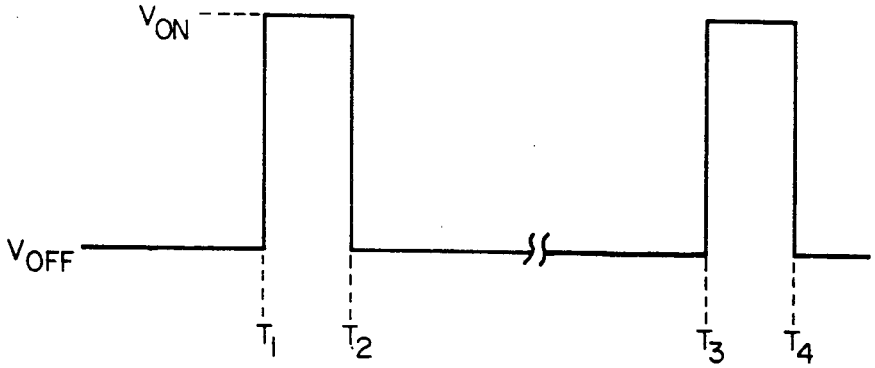
FIG. 12 shows a waveform of a gate signal.

The signal for driving the TFT 13 will be described with reference to FIG. 12 which illustrates the waveform of the gate signal applied to the gate line 12. In FIG. 12, $V_{ON}$ indicates the ON-voltage at which the TFT 13 is ON, and $V_{OFF}$ the OFF-voltage at which the TFT 13 is OFF. The level of the gate signal (i.e., the gate voltage) is changed from $V_{OFF}$ to $V_{ON}$ at time $T_1$, so that the TFT 13 turns ON and the potential of the drain electrode 13*d* and pixel electrode 14 begins to increase towards the voltage level applied to the source line 11. In this way, the "writing" of the pixel is performed. At time $T_2$, then, the level of the gate signal is reduced from $V_{ON}$ to $V_{OFF}$, thereby turning OFF the TFT 13.

The potential of the counter electrode 17 remains unchanged. As a result of the change of the level of the gate signal from $V_{ON}$ to $V_{OFF}$ at time $T_2$, therefore, the potential of the drain electrode 13*d* and pixel electrode 14 (hereinafter, referred to as "the drain potential") is shifted by $$\Delta V=(V_{ON}-V_{OFF})\cdot C_{gd}/(C_{gd}+C_{LC}) \quad (1)$$

This drain potential which has been shifted by ΔV is maintained until the next writing (i.e., between times $T_2$ and $T_3$). In other words, the drain potential is offset by ΔV with respect to the signal applied to the source line 11.

Figure 13:
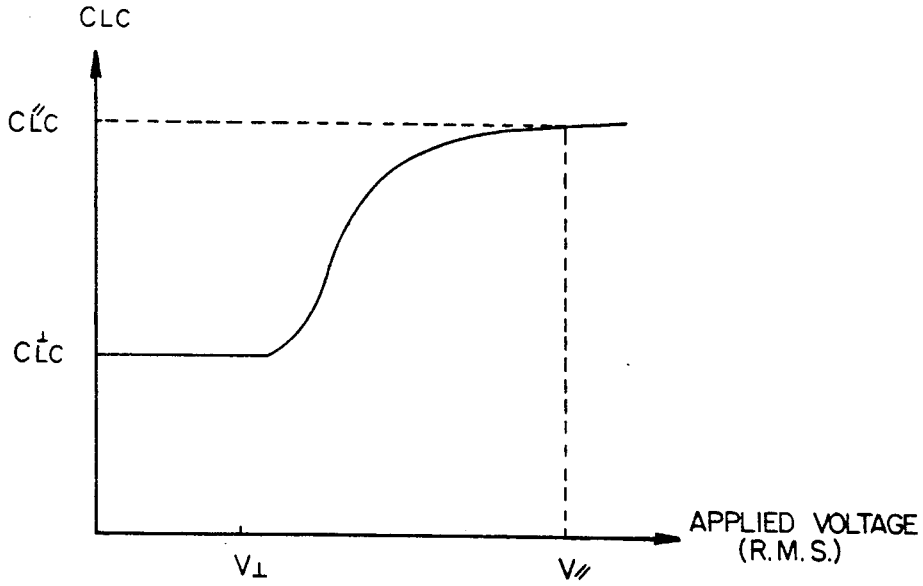
FIG. 13 is a graph illustrating the relationship between the pixel capacitance and the applied voltage.

In the expression (1) which indicates the offset voltage ΔV, $C_{LC}$ changes in accordance with the applied voltage (r.m.s.), while $V_{ON}$, $V_{OFF}$ and $C_{gd}$ are constant. FIG. 13 shows a relationship between $C_{LC}$ and the applied voltage (r.m.s.) in an LCD apparatus using the TN type liquid crystal (which is widely employed in TFT LCD apparatus). In an LCD apparatus using the TN type liquid crystal, the transmittance of the liquid crystal is changed by varying the level of the applied voltage so that images are displayed on the LCD apparatus. In other words, the value of ΔV de pends on the contents to be displayed. In the case that $V_{ON}-V_{OFF}=20$ V, $C_{gd}=0.1$ pF, $C_{LC}=0.6$ pF, and $C//_{LC}=1.4$ pF, the offset voltage ΔV can be calculated as follows:

$$\Delta V(V\perp) = 20 \times 0.1/(0.1+0.6) = 2.86\ V \quad (2)$$

$$\Delta V(V\|) = 20 \times 0.1/(0.1+1.4) = 1.34\ V \quad (3)$$

As seen from above, the offset voltage ΔV which is caused by the parasitic capacitance $C_{gd}$ of the TFT 13 is changed in a large degree (in the above example, as much as about 1.5 V) in accordance with the contents of images to be displayed. When the same pattern is displayed for a long period of time, therefore, offset voltages ΔV of different levels are applied to each pixel according to the respective contents of the pattern to be displayed therein. This means that DC voltages of different levels are applied to respective pixels for a long period of time. This prolonged application of DC voltages causes electro chemical changes in the components of each pixel (the liquid crystal, the orientation film, the protection film, etc.). These changes are memorized in the respective pixel of the LCD apparatus 1. Even when signals for the next pattern are applied to the pixels (or when offset voltages ΔV of other levels are applied to the pixels), it requires a considerable period of time to extinguish the memorized changes from the pixels. These memorized or remaining changes appear as residual images.

In this way, the residual image phenomenon is caused by the fact that the levels of offset voltages ΔV change in accordance with the contents of patterns to be displayed. Hence, if the changes of offset voltages ΔV can be corrected or compensated, the problem of the residual image phenomenon will be solved.

In this specification, when the input-output voltage characteristics substantially satisfy the relationship that an output voltage increases equally in proportion to an increase of an input voltage, the voltage characteristics (in a positive or negative polarity region, i.e., a V+ or V− region) have a substantially fixed ratio of, for example, one-to-one, which is a "substantially linear" output. If the output voltage characteristics include a portion where the output voltage does not increase in proportion to an increase of input voltage, the voltage characteristics vary (at a transition) to a ratio of input voltage to output voltage different from a one-to-one or substantially linear ratio. Thus an output voltage (which includes such a transition) has two different ratios which taken together and when viewed as a whole is a substantially "non-linear" output.

Figure 1A:
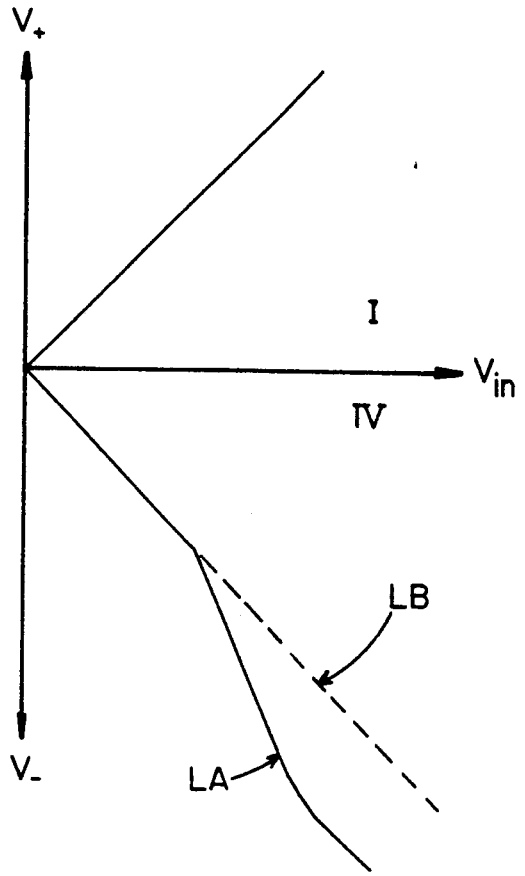
FIG. 1A illustrates the first and fourth quadrants of a voltage plot representing positive and negative regions, respectively showing the input-output characteristics of a polarity-inverting circuit used in a driving circuit according to the invention.
Figure 5:
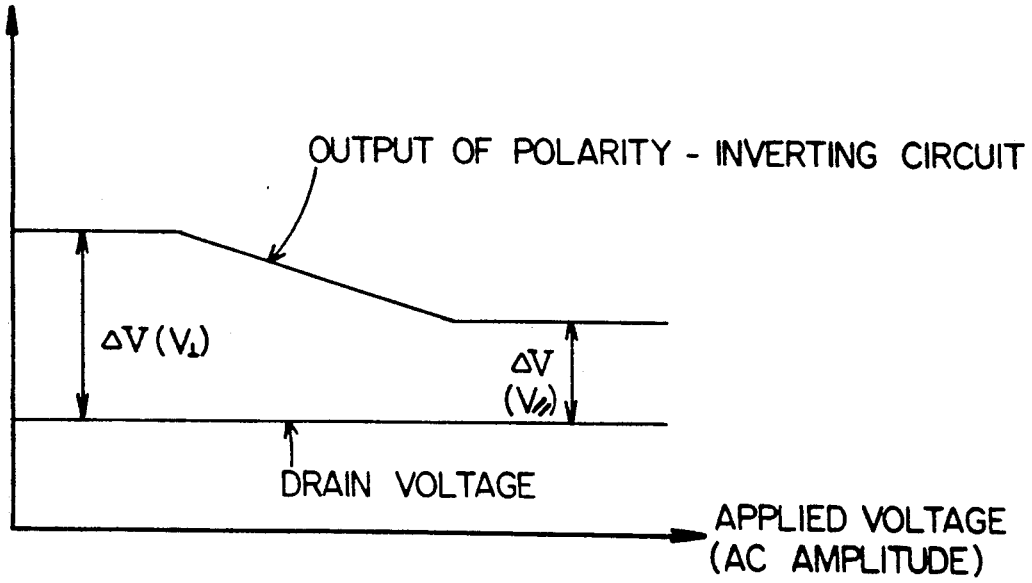
FIG. 5 is a graph showing the relationship between applied voltages and DC levels in the embodiments.

FIG. 1A shows the input-output characteristics of a polarity-inverting circuit used in a driving circuit according to the invention. In FIG. 1A, the solid line LA indicates the input-output characteristics of the embodiment, and the broken line LB that of the prior art. The driving circuit according to the invention may be generally constructed in the same manner as that of the prior art shown in FIG. 6. In this embodiment, however, the polarity-inverting circuit 5 is constructed so that the input-output characteristics in a positive region are linear in a manner similar to that of the prior art, and that the input-output characteristics in a negative region are nonlinear unlike that of the prior art (in which the input-output characteristics in both the positive and negative regions are linear). In this embodiment, the non-linear characteristics of the output of the polarity-inverting circuit in a negative region provide an input-/output relationship that, even when inputs of the same level are respectively supplied to the embodiment and to a circuit of the prior art, the output level of the embodiment is smaller than that of the prior art circuit, thereby correcting or compensating changes of the offset voltages ΔV. As a result of this correction or compensation of the changes of the offset voltages ΔV, the drain potential (DC level) is substantially constant irrespective of the contents of patterns to be As shown in FIG. 5, the DC level of signals output from the polarity-inverting circuit 5 changes in accordance with the contents of patterns to be displayed (which correspond to the AC amplitude). To the drain electrode 13*d* and pixel electrode 14, are applied signals the level of which is the sum of the level of the output signal and the offset voltage ΔV (which depends on the contents of a pattern to be displayed). Therefore, the drain potential is substantially constant irrespective of the contents of pa-,terns to be displayed. Even when the same pattern is displayed for a long period of time, consequently, the contents of the pattern are not memorized in the respective pixels, with the result that the residual image phenomenon does not occur in the LCD apparatus 1.

Figure 1B:
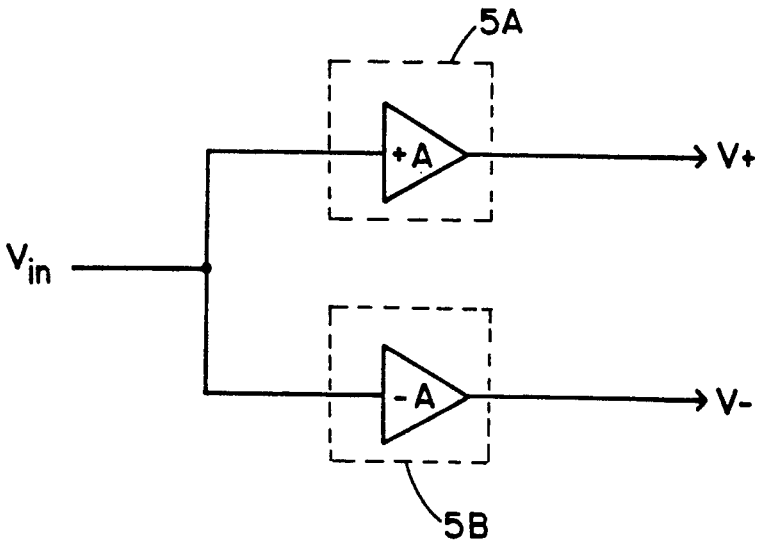
FIG. 1B is a block diagram illustrating the principal portion of the polarity-inverting circuit.
Figure 2:
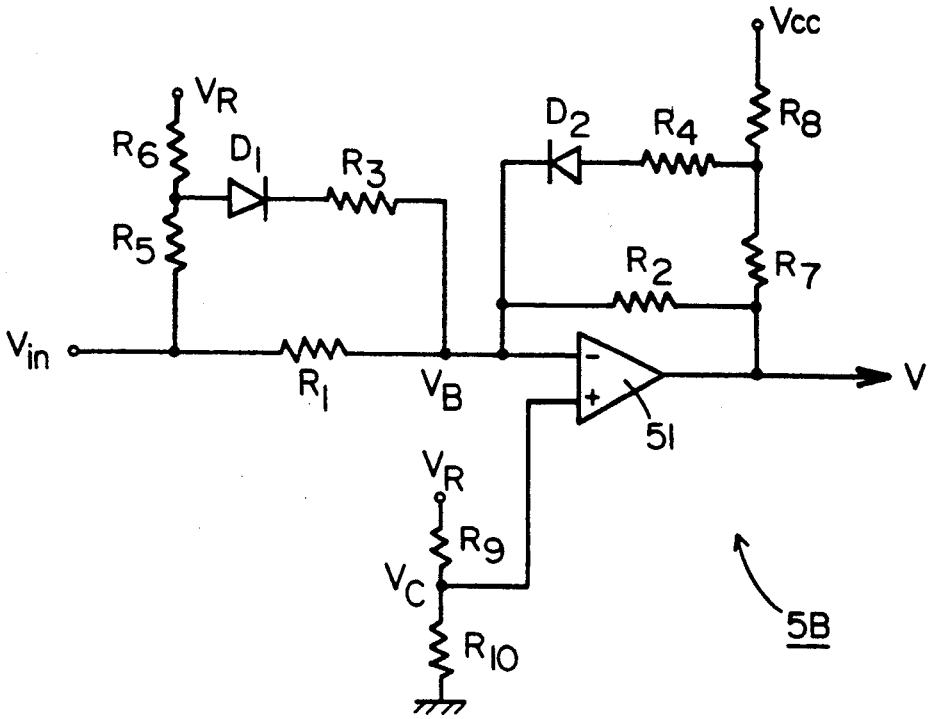
FIG. 2 is a circuit diagram of an amplifying unit used in the polarity-inverting circuit of FIG. 1B.

FIG. 1B shows the principal portion of the polarity-inverting circuit 5. In this embodiment, instead of the amplifier and inverter in a conventional circuit, the polarity-inverting circuit 5 comprises two amplifying units 5A and 5B. The amplifying unit 5A is a non-inverting amplifying unit having linear input-output characteristics, and the amplifying unit 5B is an inverting amplifying unit having non-linear input-output characteristics. The outputs $V_+$ and $V_-$ of the amplifying units 5A and 5B are alternatingly selected by a switching circuit (not shown) for each field to be output, in the same manner as in a conventional circuit. The amplifying unit 5B will be described in more detail with reference to FIG. 2. The amplifying unit 5B comprises an operational amplifier 51. Video signals $V_{in}$ are supplied to the inverting input terminal of the amplifier 51 through a resistor $R_1$. Between the inverting input terminal ($V_B$) and the output $V_-$ of the amplifier 51, is connected a resistor $R_2$. A series circuit of a resistor $R_3$, a diode $D_1$ and a resistor $R_5$ is connected in parallel with the resistor $R_1$. A power source $V_R$ is coupled to the junction point of the diode $D_1$ and the resistor $R_5$ via a resistor $R_6$. In parallel with the resistor $R_2$, a series circuit of resistors $R_7$ and $R_4$ and a diode $D_2$ is connected. At the junction point of the resistors $R_7$ and $R_4$, a power source $V_{CC}$ is coupled through a resistor $R_8$. The power source $V_R$ is also connected to the non-inverting input terminal of the amplifier 51 via a resistor $R_9$ which is connected in series with a resistor $R_{10}$ to ground.

Figure 3:
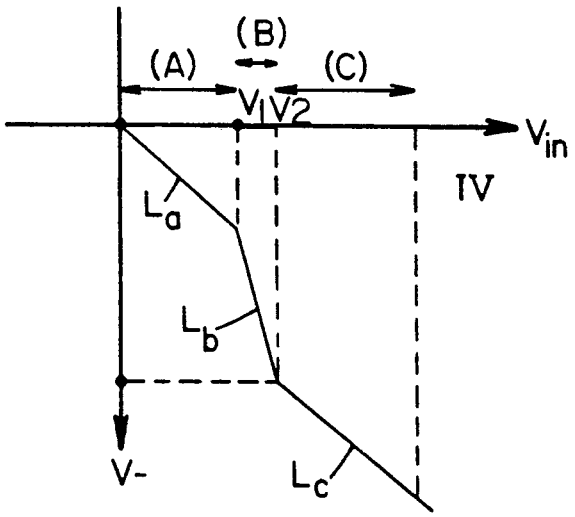
FIG. 3 illustrates the fourth quadrant of a voltage plot representing a negative region showing the input-output characteristics of FIG. 1A in more detail.

FIG. 3 illustrates in more detail the input-output characteristics of the amplifying unit 5B. When the video input signal $V_{in}$ is small (region A in FIG. 3), both the diodes $D_1$ and $D_2$ are OFF. In this case, the relationship between the input $V_{in}$ and output $V_-$ of the amplifying unit 5B follows:

$$V_{-}, = -(R_2/R_1)\cdot V_{in} + \{1 + (R_2/R_1)\}\cdot V_c \quad (4)$$

wherein $V_c$ is the potential of the non-inverting input terminal of the operational amplifier 51, and changes as the line La shown in FIG. 3. The gain $|A|$ is $R_2/R_1$.

When the input $V_{in}$ increases to reach the voltage $V_1$, only the diode $D_1$ is ON so that the series circuit of the resistors $R_3$ and $R_5$ is connected in parallel with the resistor $R_1$. This can be achieved by adequately setting the values of the resistors. In this case, the gain $|A|$ is $$|A| = R_2\cdot\{1/R_1 + 1/(R_3 + R_5)\} \quad (5)$$

The voltage $V_1$, which is a changing point, is $$V_1 = \{(V_B - V_F - V_R)/R_6\}\cdot R_5 + (V_b - V_F) \quad (6)$$

wherein $V_F$ means the voltage drop of the diodes (about 0.7 V in the case where the diodes are silicon diodes). The relationship between the input $V_{in}$ and output $V_-$ changes as the line Lb shown in FIG. 3.

When the input $V_{in}$ further increases to reach the voltage $V_2$, the diode $D_2$ turns ON while the diode $D_1$ remains ON. This ON operation causes the series circuit of the resistors $R_4$ and $R_7$ to be connected in parallel with the resistor $R_2$. Therefore, the gain $|A|$ drops and can be expressed by the following $$|A| = \{1/R_1 + 1/(R_3 + R_5)\}/\{1/R_2 + 1/(R_4 + R_7)\} \quad (7)$$

The relationship between the input $V_{in}$ and output $V_-$ changes as the line Lc shown in FIG. 3. The voltage $V_2$, which is another changing point, is $$V_2 = \{(V_{cc} - (V_8 + V_F)/R_8\{\cdot R_7 + (V_5 + V_F) \quad (8)$$

Figure 4:
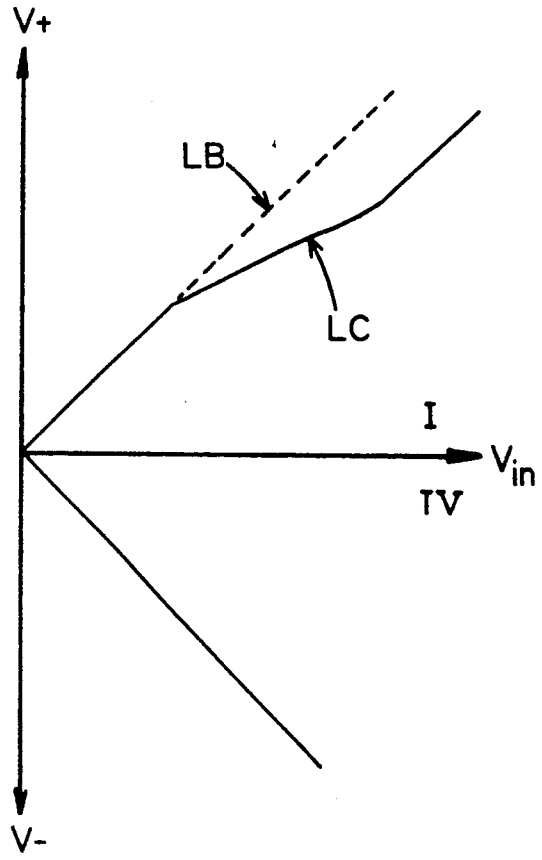
FIG. 4 illustrates the first and fourth quadrants of a voltage plot representing positive and negative regions, respectively showing the input-output characteristics of a polarity-inverting circuit used in another driving circuit according to the invention.

FIG. 4 shows the input-output characteristics of a polarity-inverting circuit used in another driving circuit according to the invention, in which the amplifying unit 5A has non-linear input-output characteristics and the amplifying unit 5B has linear input-output characteristics. In this embodiment, as shown by the solid line LC, the input-output characteristics in the negative region are linear in a manner similar to that of the prior art, and that the input-output characteristics in the positive region are non-linear unlike that (the broken line LB) of the prior art (in which the input-output characteristics in both positive and negative regions are linear). According to this embodiment, the drain potential can be maintained substantially constant in the similar manner as the above-described embodiment.

Alternatively, both the amplifying units 5A and 5B may have non-linear input-output characteristics, so that the input-output characteristics of the polarity-inverting circuit are non-linear in both positive and negative regions.

In the embodiments, the polarity-inverting circuits have non-linear input-output characteristics by which the drain potential is maintained constant. The kind of non-linear input-output characteristics are not restricted to the above, provided that the variation of the offset voltage can be suppressed.

As seen from above, the driving circuit according to the invention can drive an LCD apparatus without causing the residual image phenomenon. Therefore, the driving circuit according to the invention is very useful in driving an LCD apparatus used in office automation equipment in which the same pattern may be displayed for a long period of time.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A driving circuit for a liquid crystal display apparatus, comprising a polarity-inverting circuit for converting input video signals into polarity-alternating signals, said polarity-inverting circuit having at least one diode and having input-output voltage characteristics which in at least one of a positive polarity region or a negative polarity region include first and second transitions, said voltage characteristics being substantially linear between the first and second transitions having a ratio of input voltage to output voltage which is substantially fixed, and said voltage characteristics after the second transition having a ratio of input voltage to output voltage different from the ratio between the first and second transitions.

2. A driving circuit according to claim 1, wherein said voltage characteristics are substantially linear in the positive polarity region.

3. A driving circuit according to claim 1, wherein said voltage characteristics are substantially linear in the negative polarity region.

4. A driving circuit for a liquid crystal display apparatus according to claim 1, wherein said first and second transitions are two voltage levels which are related to capacitance-voltage characteristics of the liquid crystal display.

5. A driving circuit for a liquid crystal display apparatus, comprising a polarity-inverting circuit for converting input video signals into polarity-alternating signals; including an amplifier, a first series including a diode and a resistor connected to an input of said amplifier at one end of said first series, and connected to a point between two resistors at the other end of said first series, a second series including a diode and a resistor connected to an output of said amplifier through a resistor at one end of said second series, and connected to the input of said amplifier at the other end of said second series, an input terminal at an end of each of said two resistors remote from said point for supplying input video signals $V_{in}$ and a power source $V_R$ respectively, and a terminal connected through a resistor to said one end of said second series for supplying a power source voltage Vcc;

so that when said diode connected to said output of said amplifier is turned on, a ratio of combined resistance at the input of said amplifier to a combined resistance at the output of said amplifier is altered to produce at least two different ratios of input voltage to output voltage.

6. A driving circuit for a liquid crystal display apparatus according to claim 5, wherein said at least two different voltage ratios of input voltage to output voltage relate to predetermined voltages corresponding to the capacitance-voltage characteristics of the liquid crystal display.

7. A driving circuit for a liquid-crystal display apparatus, comprising:

a polarity-inverting circuit for converting input video signals into polarity-alternating signals, and wherein said polarity-inverting circuit has input-output voltage characteristics which are substantially linear in one of a positive and a negative polarity region, and which include at least two different voltage ratios of input voltage to output voltage in the other of said positive and negative polarity regions, said different voltage ratios corresponding to the capacitance-voltage characteristics of a liquid crystal material in said display apparatus.

* * * * *